US007636960B2

(12) United States Patent
Hawley et al.

(10) Patent No.: US 7,636,960 B2
(45) Date of Patent: Dec. 29, 2009

(54) INTEGRAL BATH MAT WITH ZONED CHARACTERISTICS AND METHOD OF MAKING A BATH MAT

(75) Inventors: James K Hawley, Sheffield Village, OH (US); Elizabeth A. Flores, Sheffield Lake, OH (US); Roberta I. Gareau, North Ridgeville, OH (US); Christine Hayes, Lakewood, OH (US); Patrice J. Sarb, Avon, OH (US)

(73) Assignee: Shurtech Brands, LLC, Hickory, NC (US)

( * ) Notice: Subject to any disclaimer, the term of this patent is extended or adjusted under 35 U.S.C. 154(b) by 726 days.

(21) Appl. No.: 10/385,456

(22) Filed: Mar. 12, 2003

(65) Prior Publication Data

US 2005/0071915 A1 Apr. 7, 2005

Related U.S. Application Data

(63) Continuation of application No. 09/854,388, filed on May 14, 2001, now Pat. No. 6,564,397.

(51) Int. Cl.
*A47K 3/02* (2006.01)

(52) U.S. Cl. ..... 4/583

(58) Field of Classification Search ..... 4/580–583; 428/101, 187, 103, 217
See application file for complete search history.

(56) References Cited

U.S. PATENT DOCUMENTS

| | | | | |
|---|---|---|---|---|
| 1,510,647 | A | 10/1924 | Bomar | |
| 1,613,158 | A | 1/1927 | Brewer | |
| 2,081,992 | A | 6/1937 | Gavlak | |
| 2,217,821 | A | 10/1940 | Shiner | |
| 2,495,602 | A | 1/1950 | Rinaldi | |
| 2,822,553 | A | 2/1958 | Florentine | |
| 3,091,779 | A | 6/1963 | Lucas et al. | |
| 3,341,866 | A | 9/1967 | Wright | |
| 3,408,663 | A | 11/1968 | Bunting | |
| 3,418,668 | A | 12/1968 | Anderson et al. | |
| 3,999,224 | A * | 12/1976 | Kollsman | 4/583 |
| 4,167,599 | A | 9/1979 | Nissinen | |
| 4,285,075 | A | 8/1981 | Nelson | |
| 4,512,044 | A | 4/1985 | Clark | |
| 4,625,344 | A | 12/1986 | Howard | |
| 4,828,902 | A * | 5/1989 | Welygan et al. | 428/105 |
| 5,051,477 | A | 9/1991 | Yu et al. | |
| D327,388 | S | 6/1992 | Phillips | |
| 5,293,660 | A | 3/1994 | Park | |
| 6,014,779 | A | 1/2000 | Lindholm | |
| 6,017,586 | A | 1/2000 | Payn et al. | |
| 6,289,528 | B1 * | 9/2001 | Ridder et al. | 4/583 |
| 6,681,416 | B1 * | 1/2004 | Yang | 4/583 |
| 2002/0018877 | A1 * | 2/2002 | Woodall et al. | 428/180 |

* cited by examiner

*Primary Examiner*—Huyen Le
(74) *Attorney, Agent, or Firm*—Fay Sharpe LLP

(57) ABSTRACT

A bath mat comprises a base member made from a first elastomeric material and at least one contrast member differing from the base member but manufactured to be integral with the base member through an over-molding or co-molding process. The contrast member differs in color and/or hardness or feel from the base member providing improved aesthetics and functionality.

63 Claims, 4 Drawing Sheets

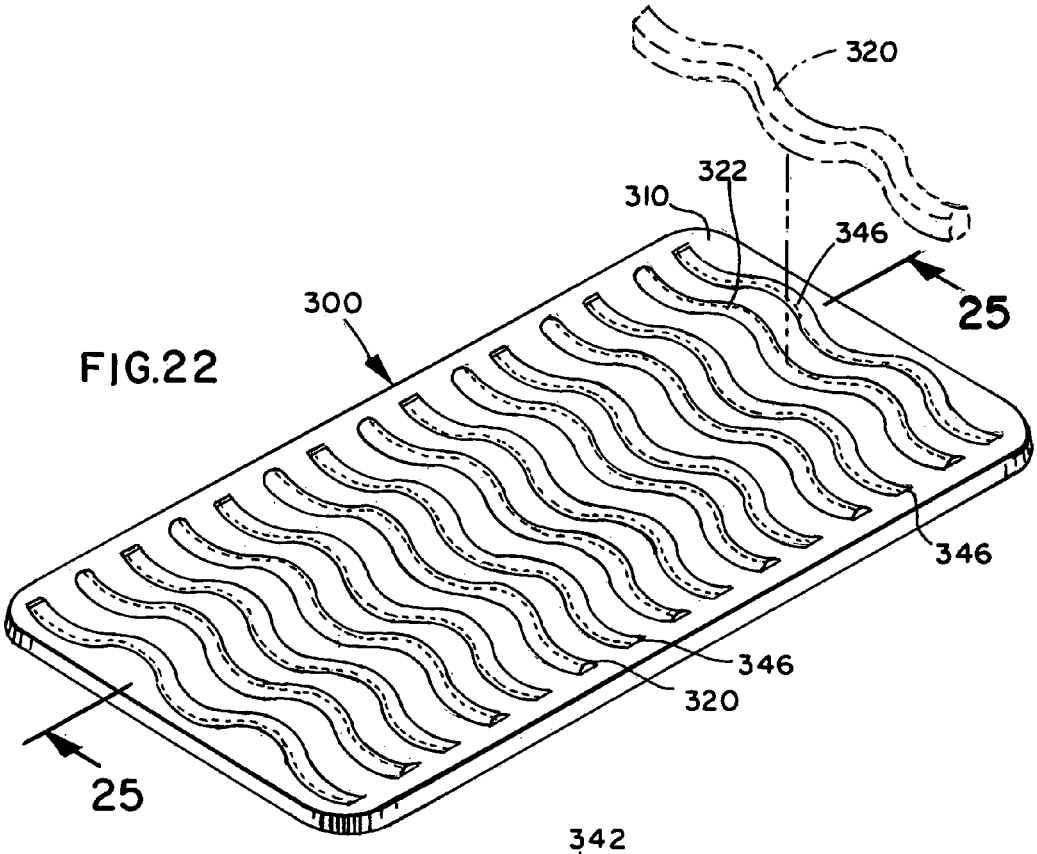
FIG.22
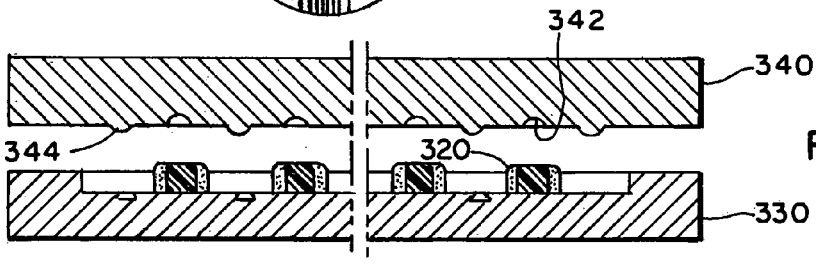
FIG.23
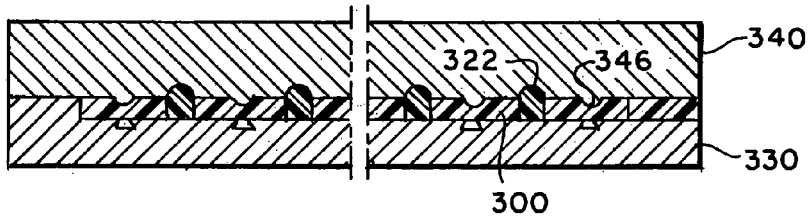
FIG. 24
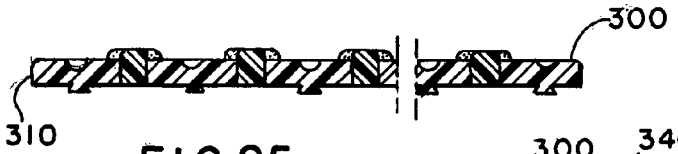
FIG.25
FIG.26
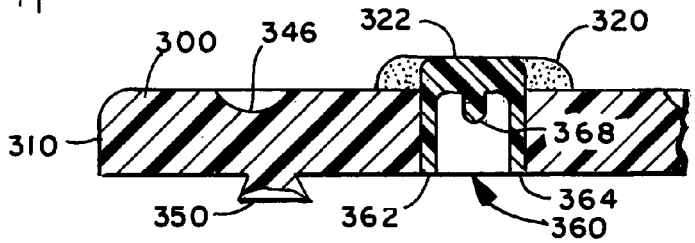

INTEGRAL BATH MAT WITH ZONED CHARACTERISTICS AND METHOD OF MAKING A BATH MAT

This patent application is a continuation of application Ser. No. 09/854,388 filed on May 14, 2001, now U.S. Pat. No. 6,564,397 and incorporated herein by reference.

BACKGROUND OF THE INVENTION

This invention relates to bath mats of the type to be removably placed in the bottom of a bath tub or shower and operable under wet conditions.

Bath mats are commonly used in households throughout the United States. The mats are often placed in a bath tub having a shower curtain and stood upon while one takes a shower. Such bath mats are often rectangular sheets of flexible polymeric material having uniform characteristics and color. Bath mats are sold through general merchandising channels of trade and are available from numerous sources. Available bath mats add only minimally to the appearance and functionality of a bathroom.

SUMMARY OF THE INVENTION

In accordance with the present invention, a bath mat is provided in which different zones have different characteristics resulting in an improved appearance and texture.

Further in accordance with the invention, a bath mat is provided comprising a base member fabricated from a first elastomeric material and at least one contrast member comprising a second elastomeric material differing from the first elastomeric material but manufactured integrally therewith.

Yet further in accordance with the invention, a bath mat is provided having a base member of a first color and hardness, and contrast members differing in color and hardness from the base member; the contrast members being integrally formed with the base member.

Yet further in accordance with the invention, a bath mat is provided having a generally rectangular base member and contrast members integral to said base member, the contrast members top surfaces being raised above the base member and having a feel different from the base member.

Still further in accordance with the invention, a method of manufacturing a bath mat is provided in which a base member is injection molded of a first elastomeric material and contrast members are then over-molded onto and integrally with the base member creating a bath mat with zoned characteristics. Alternatively, contrast members or inserts are molded and a base member then molded around the contrast members becoming a unitary mat.

It is a primary object of the present invention to provide a bath mat having improved aesthetics, durability and function.

It is another object of the present invention to provide a bath mat having zones with a different feel integrally manufactured into a bath mat.

It is still another object of the present invention to provide a method of manufacturing a bath mat which economically creates an aesthetically pleasing durable bath mat having zones of different color or hardness.

BRIEF DESCRIPTION OF THE DRAWINGS

The foregoing objects, and others, will in part be obvious and in part pointed out more fully hereinafter in conjunction with the written description of the preferred embodiments of the invention illustrated in the accompanying drawings in which:

FIG. 22 is a perspective view of a bath mat in accordance with the invention made in another molding technique;

FIG. 23 is a cross section of a mold for creating the mat of FIG. 22 in the open portion;

FIG. 24 is a cross section of the mold of FIG. 23 in the closed and loaded position;

FIG. 25 is a cross section of the mat as molded in FIGS. 23 and 24 taken along line 25-25 of FIG. 22; and, FIG. 26 shows details of a portion of the base member and a contrast member as seen in FIGS. 22-25 at a larger scale.

DESCRIPTION OF PREFERRED EMBODIMENTS

Figure 1:
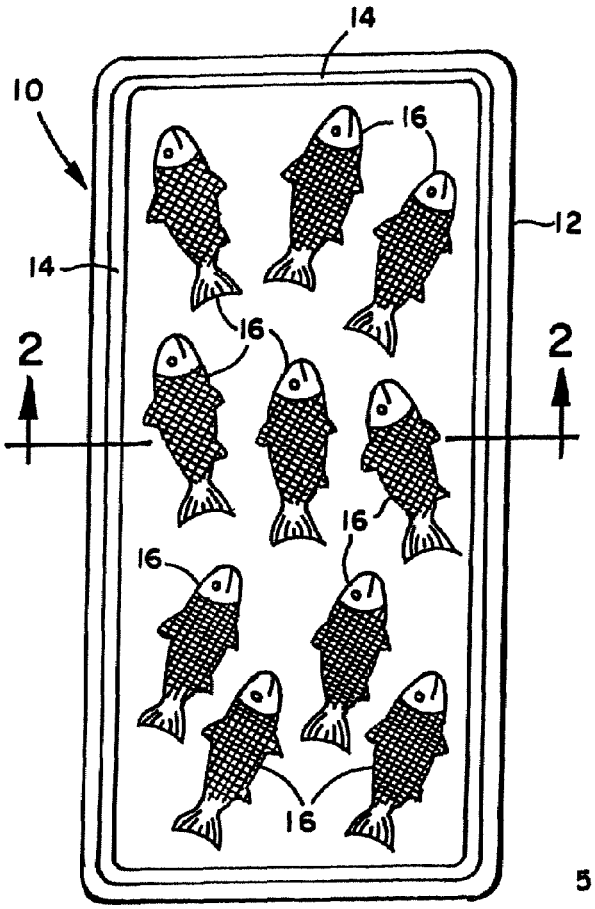
FIG. 1 is a top plan view of a bath mat in accordance with the present invention.

Referring now in greater detail to the drawings wherein the showings are for the purposes of illustrating preferred embodiments of the invention and not for the purpose of limiting the invention, FIG. 1 illustrates a bath mat 10 in accordance with the present invention. The bath mat comprises a base member 12 which is generally rectangular and fabricated from a first elastomeric material. The bath mat 10 is shown in cross-section in FIG. 2. Base member 12 is generally rectangular with rounded corners and is profiled with a peripheral upstanding rib 14. Other profiling, such as suction cups on the bottom or the like could also be implemented in the base member 12 as desired. The base member 12 is fabricated from an elastomeric material. Appropriate materials include thermoplastic olefins (TPOs) and other thermoplastic elastomers (TPEs). Such materials are widely available from vendors including Advanced Elastomer Systems of St. Louis, Mo. and Shell Chemicals. Appropriate materials from Advanced Elastomer Systems include Vistaflex 671N thermoplastic rubber and Vistaflex 641N thermoplastic rubber. Various Shell products sold under the trademark Kraton are appropriate. Other materials such as PVC or Silicone can be selected to meet specific application needs. Fillers, coloring agents, plasticizers, and catalysts are added as is conventional to achieve appropriate Durometer hardness, density and other physical characteristics.

Referring again to FIG. 1, several contrast members 16 are positioned within the bath mat 10. The contrast member 16 are in the shape of stylized fish and their upper surfaces are textured with grooves 18. The grooves 18 add non-slip functionality. The contrast member 16 are fabricated from a material similar to the material used in the bath mat base member 12. The same thermoplastic olefin or thermoplastic elastomer is conveniently used. However, a different thermoplastic olefin or thermoplastic elastomer can be used. Silicone or flexible polyvinylchloride or other suitable elastomers may also be used. The material is compounded to have a Shore A hardness different in the contrast member 16 when compared to the base member 12. The material is also compounded to have a color different in the contrast member 16 when compared to the base member 12. The contrast members 16 are integrally formed with the base member 12 forming an integral bath mat 10. The process for achieving this is shown schematically in FIG. 21.

An injection molding machine has a two-part mold comprising a back mold half 22 and front mold half 24. Elastomeric material is injected into a cavity 26 formed by the two mold halves having a shape desired for the base member 12. After the plastic is injected into the cavity 26 forming the base member 12, the front mold half 24 is pulled away from the back mold half 22 leaving the base member 12 in place in the back mold half 22. The back mold half 22 and base member 12 are then rotated and a second front mold half 28 is brought into engagement with the base member 12. A second elastomeric material is injected through the second front mold half 28 into cavities 30, 32 having the shapes desired for the contrast members 16. It is possible to use multiple injection screws to fill the separate cavities 30, 32. This allows use of a third or even a fourth material to add colors or textures to the mat as desired.

The elastomeric material to form the base member 12 and the elastomeric material to form the contrast members 16 are very similar in molding characteristics and melting points. The injection molding of the contrast members 16 directly against base member 12 causes the contrast members 16 to weld to the base member 12 and then create a unitary bath mat 10. While the contrast members 16 may have different characteristics such as color, surface texture, surface skin feel, and Shore A hardness, the contrast members 16 are welded to and unitary with the base member 12.

After the injection molding of the contrast member 16 through the second front mold half 28, the second front mold half 28 is separated from the back mold half 22 and finished bath mat 10 ejected. Thus, an integrated two-step molding process starts with two resin compounds and produces a finished bath mat. A base member is molded with a back mold half and a first mold half, then contrast members are integrated into the base member and molded with the same back mold half and a second front mold half or over-mold half.

Figure 3:
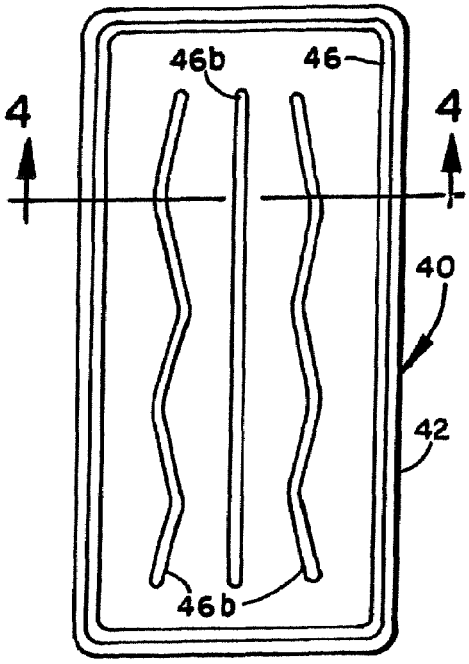
FIG. 3 is a top plan view of another bath mat in accordance with the present invention.
Figure 4:
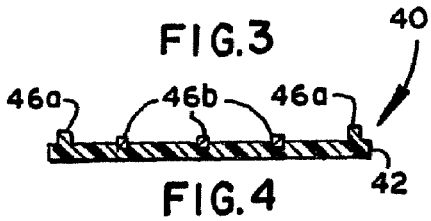
FIG. 4 is a cross-sectional view taken along line 4-4 of FIG. 3.

FIGS. 3 and 4 show a second embodiment of the invention. FIG. 3 shows a bath mat 40 in top plan view comprising a base member 42 and contrast members 46. The base member 42 is generally rectangular and is molded with several grooves to accommodate contrast members 46. One groove is a generally rectangular peripheral groove around the entire periphery of the base member 42. A contrast member **46*a* fills this groove and, as seen in FIG. 4, extends above the top of the base member 42. The peripheral contrast member 46*a* is positioned similarly to the peripheral upstanding rib 14 seen in FIG. 1. However, because it is a contrast member, it will have characteristics different from the base member. Thus, it will be easier to see and feel as the color and Shore A hardness is different. In the preferred embodiment, the colors are selected to be contrasting and the Shore A hardness of the contrast member 46 is selected to be significantly different than the Shore A hardness base member 42; e.g. base member Shore A hardness 80 and contrast member Shore A hardness 60. The remaining contrast members 46*b* are wavy ribs contained within the boundaries of the peripheral contrast member 46*a*** and easily distinguishable therefrom because of their waviness. Thus, a person showering on this mat will be able to determine his or her location on the mat by feel.

Figure 6:
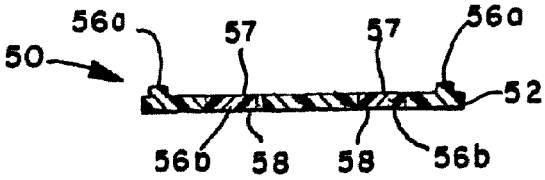
FIG. 6 is a cross-sectional view taken along line 6-6 of the bath mat seen in FIG. 5.
Figure 5:
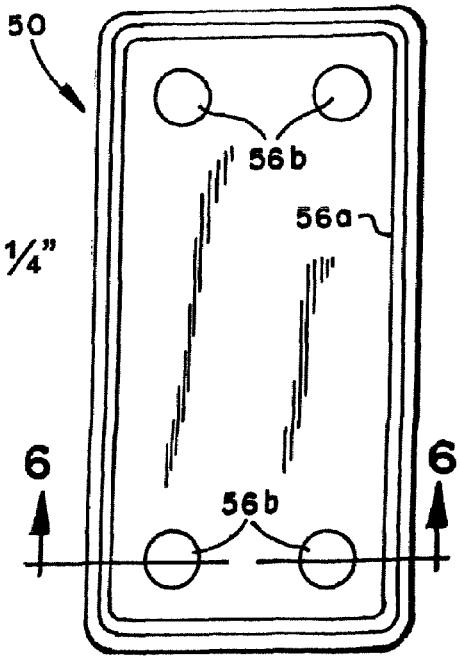
FIG. 5 is a top plan view of still another bath mat in accordance with the present invention.

FIGS. 5 and 6 illustrate yet another embodiment of the invention. A bath mat 50 comprises a base member 52, a peripheral contrast member **56*a* and several round contrast members 56*b*. As can be seen in FIG. 6, the peripheral contrast member 56*a* is accommodated in a peripheral groove which does not penetrate through the entire depth of the base member 52. The round contrast members 56 however do penetrate through the entire depth of the base member 52. The round contrast members have top surfaces 57 which are coplanar with the top surface of the base member 52 and bottom surfaces 58 which are coplanar with the bottom surface of the base member 52**. In this way, the bottom of the mat is provided with areas having the same color and Shore A hardness as the contrast member tops. Thus, softer (or harder) areas may be provided on the bottom as well as the top of the mat. The top and/or bottom surfaces of the round contrast members can be domed to extend above the base member, cupped or textured.

Figure 7:
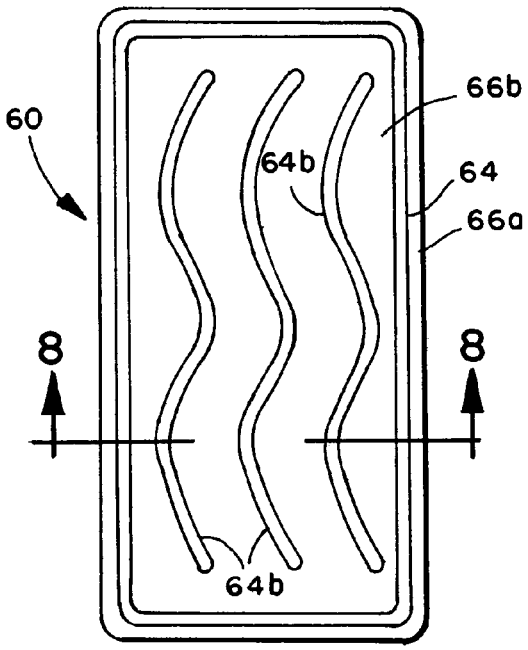
FIG. 7 is a top plan view of still another bath mat in accordance with the present invention.
Figure 8:
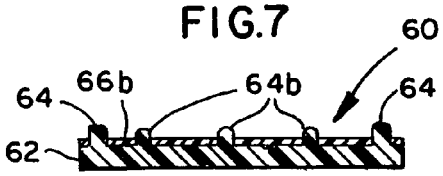
FIG. 8 is a cross-sectional view taken along line 8-8 of the bath mat seen in FIG. 7.

FIGS. 7 and 8 illustrate yet another embodiment of the present invention. A bath mat 60 comprises a base member 62, a peripheral contrast member **66*a* and a central contrast member 66*b*. The base member 62 has a generally flat bottom and is generally rectangular in shape with rounded corners. Of course, suction cups, grooves or texturing can be added to the bottom. The base member 62 is almost entirely covered by the contrast members 66*a*, 66*b*. A base member peripheral upstanding rib 64 is spaced inwardly from the edge of the mat 60 and is generally rectangular. The rib 64 separates the peripheral contrast members 66***a* from the central contrast member 66*b*. The base member 62 also has three central ribs 64*b*. The central ribs 64*b* are long, narrow, wavy ribs projecting through the central contrast member 66*b*.

From the top, the bath mat 60 of FIG. 7 resembles the bath mat 40 of FIG. 3. However, in the bath mat 60, the ribs protruding through the top flat surface of the bath mat are extensions of the base member 62 rather than contrast members. In this way, the ribs will have the same color and hardness as the bottom surface of the base member 62. In the bath mat 40 seen in FIGS. 3 and 4, the ribs have a different color and different hardness from the bottom of the base 42.

Figure 20:
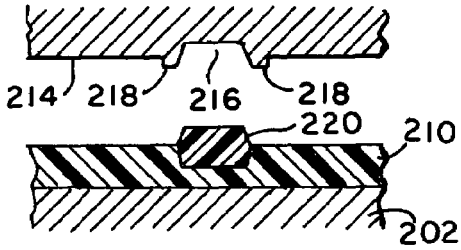
FIG. 20 shows a detail of a second mold or over mold in accordance with the present invention and a detail of a bath mat having a base member and contrast member created by the over mold in the base member seen in FIG. 19.
Figure 21:
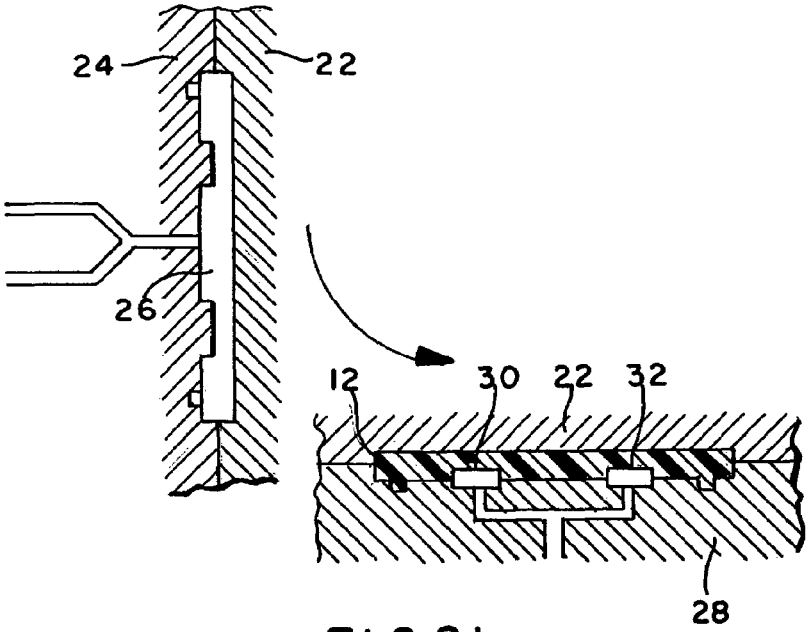
FIG. 21 shows, schematically, the process of using a first mold followed sequentially by use of a second mold with the work piece created in the first mold.

All of the bath mats 10, 40, 50, and 60 seen in FIGS. 1-8 are made in the over molding process illustrated in FIG. 21. The differences in the bath mats are accomplished by changing the configurations of the back mold half 22 and the front mold halves 24, 28. The base member is molded between the back mold half 22 and the first front mold half 24. Thereafter, the back mold half 22, with the base member still in place, is repositioned to be engaged by a second front mold half 28 which seals against the back mold half and portions of the base member. There are sealing techniques which can be used to assure that the elastomeric material forming the contrast elements are retained within the appropriate cavities 30, 32 are illustrated in FIGS. 9-20. These techniques are illustrated with cross-section appropriate to form a rib. The techniques are of general applicability and can be used with cavities which will form fish-shapes, round shapes passing through the entirety of the base member, ribs, or a multitude of other shapes which one may find appropriate for use as contrast members. The sealing techniques of FIGS. 9-20 are all illustrated with respect to creation of contrast members which do not penetrate through the base member in its entirety. These techniques may also be adapted for use with contrast members completely penetrating the base member as-is seen in back mat 50 of FIGS. 5 and 6.

Figure 9:
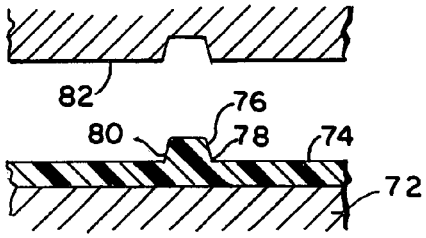
FIG. 9 is a cross-sectional view of a detail of an injection mold and resulting base member manufactured in accordance with the present invention.
Figure 10:
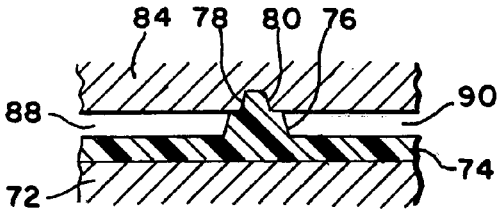
FIG. 10 is a detail of a second mold or over mold applied to the base member seen in FIG. 9.
Figure 11:
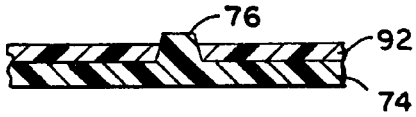
FIG. 11 is a detail view of a finished bath mat showing the contrast member having been injected when the mold and base member are disposed as seen in FIG. 10.

Referring to FIG. 9, a portion of a back mold half 72 is shown supporting a portion of a base member 74 having an upstanding rib 76. The rib 76 has side walls 78, 80 which are not parallel but converged toward one another in the upward direction. This is generally known as draft. The converges can be very gentle, as small as a half of degree to one degree. The base member 74 and rib 76 are formed by the interaction of the back mold half 72 and first front mold half 82. FIG. 10 shows the interaction of a second front mold half 84 and the base member 74. The second front mold half 84 has a recess 86 which engages the top portion of the rib 76 and compresses it, forcing the side wall 78, 80 toward one another. With the second front mold half 84 fully engaged, cavities 88, 90 are defined between the second front mold half 84, the back mold half 72, the rib 76, and other ribs or mold parts (not shown). These cavities are filled as is illustrated in FIG. 21 resulting in the structure seen in FIG. 11. FIG. 11 shows a detail of a finished bath mat comprising a base member 74, a contrast members 92 and a base member rib 76 extending upwardly from the base member 74 and separating portions of a single contrast member-92 or several separate contrast members 92.

Figure 12:
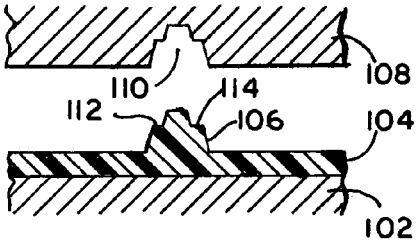
FIG. 12 is a detail of another mold and base member created by said mold in accordance with the present invention.
Figure 13:
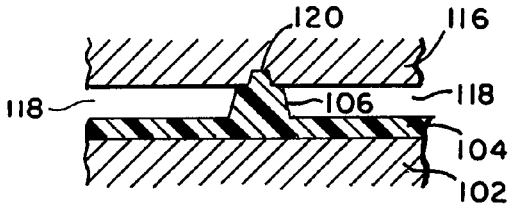
FIG. 13 is a detail of a second mold or over mold applied to the base member created in FIG. 12 in accordance with the present invention.
Figure 14:
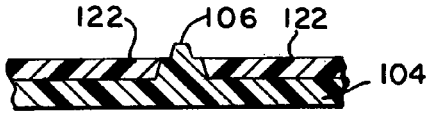
FIG. 14 is a detail view showing a base member and contrast member fused into a bath mat as created by the second mold or over mold shown in FIG. 13.

FIGS. 12, 13 and 14 show a second technique for isolating contrast members. A back mold half 102 supports a base member 104 having a rib 106. The rib 106 and base member 104 are formed by injection molding elastomeric material between the back mold half 102 and a first front mold half 108 having a recess 110 which forms the rib 106. The rib 106 is formed to have sides with draft as is conventional. Additionally, substantially horizontal shoulders 112, 114 are formed in the sides of the rib 106. Referring now to FIG. 13, a second front mold half 116 engages the rib 106 defining cavities 118. A recess 120 in the second front mold half 116 accommodates the top of the rib 106. The portion of the second front mold half directly adjacent both sides of the recess 120 engage the shoulders 114, 116 of the rib 106, downwardly compressing the shoulders slightly. This forms a seal, isolating the cavities 118 so that well-defined contrast members 122 (FIG. 14) are created. The shoulders 112 can be other than horizontal. If other than horizontal shoulders are desired, the recess 120 in the second front mold half 116 will be changed to accommodate the new shape. However, horizontal shoulders allow direct compression of the base member and horizontal, or close to horizontal, is preferred.

Figure 15:
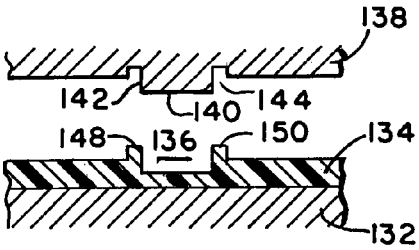
FIG. 15 is still another detail of a mold and the base member created by this mold in accordance with the present invention.
Figure 16:
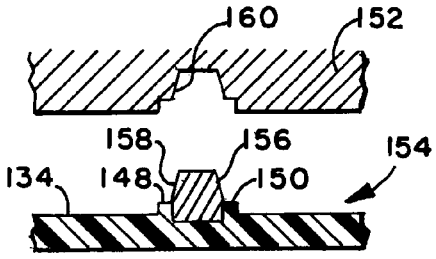
FIG. 16 is a detail view of a second mold or over mold and the finished bath mat comprising a base member and contrast member created by the second mold.

FIGS. 15 and 16 show another technique for forming discrete contrast members. In FIG. 15, a back mold half 132 supports a base member 134 having a recess 136 formed in its top. The base member 134 and recess 136 are formed by corresponding surfaces in a first front mold half 138. The front mold half 138 has a downwardly extending projection 140 flanked by two small recesses 142, 144. Small recesses 142, 144 form small upstanding ridges 148, 150 having flat top surfaces in the base member. The ridges 148, 150 can be very small and very short.

FIG. 16 shows a second front mold half 152 and a detail of the finished bath mat 154 created by the interaction of the second front mold half 152, and the base member 134. The second front mold half 152 has a recess 160. When the second front mold half 152 is closed against the base member 134, the portions of the second front mold half 152 adjacent the recess 160 compress the ridges 148, 150 in the base member 134. This seals a cavity defined by the recess 160 and the recess in the base member 136 (FIG. 15) created by the first front mold half 138. Elastomeric material is filled into the cavity creating a contrast member 156. The contrast member 156 extends beyond the top of the small upstanding ridges 148, 150 and has a top profile 158 corresponding to a recess 160 in the second front mold half 152.

Figure 17:
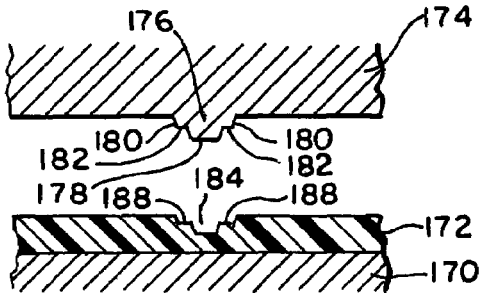
FIG. 17 shows another first mold and base member created by a first mold in accordance with the present invention.
Figure 18:
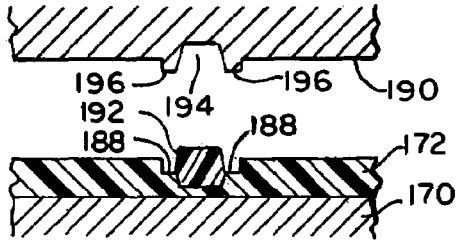
FIG. 18 shows detail of a second mold and the finished bath mat created by the second mold in accordance with the present invention.

FIGS. 17 and 18 illustrate another technique for creating well-defined contrast members in a bath mat. FIG. 17 shows a back mold half 170, a base member 172, and a first front mold half 174. The front mold half 174 includes a projection 176 having a flat bottom 178 and slightly tapered side walls 180 having horizontal shoulders 182. The projection 178 creates a recess 184 in the base member having horizontal shoulder 188 in its side walls.

FIG. 18 shows a second front mold half 190 adapted to form a contrast member 192 in the base member 172. The second front mold half 190 includes a recess 194 and ridges 196 on both sides of the recess 194. When the second front mold half 190 is engaged against the base member 172, the ridges 196 compress the base member 172 at the horizontal shoulders 188. This seals a cavity defined by the recess 184 in the base member 172 and the recess 194 in the second front mold half 190. This volume is then filled with elastomeric material which becomes the contrast member 192.

Figure 19:
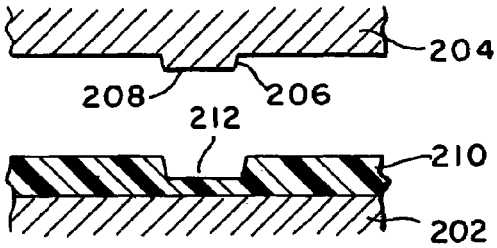
FIG. 19 shows a detail view of another first mold and base member created in accordance with the present invention.

FIGS. 19 and 20 illustrate yet another sealing technique usable in creating contrast members in the present invention. In FIG. 19, a back mold half 202 and a first front mold half 204 are illustrated. The front mold half 204 has a projection 206 having slightly converging walls as is conventional and a flat bottom 208. The two mold halves 202 and 204 are shown disengaged. A base member 210 as created by the two mold halves is shown still engaged on the back mold half 202. The base member 210 includes a recess 212 created by the projection 206.

FIG. 20 shows the back mold half 202, the base member 210, a second front mold half 214 having a recess 216. Ridges 218 are provided adjacent the sides of the recess 216. When the second front mold half 214 is engaged against the base member 210, the ridges 218 compress a portion of the base member 210 on either side of the recess 212. This seals the cavity comprising the recess 212 in the base member and the recess 216 in the second front mold half. This cavity is filled with elastomeric material which becomes the contrast member 220.

All of the sealing techniques described above can be used in the present invention to create contrast members of a wide variety of shapes and sizes. While ridges are shown in the details of FIGS. 9-20, fanciful shapes such as fish shapes, wave shapes, rings, letters of the alphabet, or other shapes can be accomplished in this manner. Moreover, the sealing technique can be used for contrast members of various sizes and various penetrations through the base member.

Another embodiment of the invention is shown in FIG. 22 and FIG. 25 and the method of making this embodiment is shown in FIGS. 23 and 24. A bath mat 300 is comprised of a base member 310 and multiple insert members 320. The mat 300 contains approximately 7 identical serpentine insert members 320. One insert member is shown in phantom in isolation in FIG. 22. In this embodiment of the invention, the insert members 320 are molded as individual inserts. As seen in FIG. 23, the insert members 320 are then inserted into the bottom half 330 of a mold and fixed in place. The bottom half 330 of the mold may have slight recesses or other indicia to indicate placement of the inserts 310. As can also be seen in FIG. 23, the insert tops 322 extends slightly above the uppermost surface of the bottom half of the mold 330.

The top half of 340 of the mold is also seen in FIG. 23. The top half of the mold 340 includes recesses 342 positioned above the insert members 320. Protrusions 344 are also provided in the mold top half 340 to create recesses 346 and the bath mat 300. As seen in FIG. 22, the recesses 346 alternate with the insert 320 providing a pleasing appearance and texture.

As seen in FIG. 24, once the inserts 320 are in place, the mold top half 340 and the mold bottom half 330 are brought together and plastic material differing from the plastic material of the insert members is injected into the cavity. The material completely surrounds the insert members 320 and binds to the insert members 320 creating a unitary bath mat as shown in cross section in FIG. 25 and perspective in FIG. 22. The finished bath mat 300 comprises a base member 310 which is generally rectangular in shape and several insert members 320. The base member 310 has a generally flat bottom and all of the insert members 320 also have generally flat bottoms. The flat bottom of the insert members 320 are generally coplanar with the flat bottom of the base member 310 providing a bath mat with a generally flat and planar bottom surface. Alternatively, suctioned cups can be molded into the base member 310 and/or the insert members 320. As previously described, the upper portion of the insert members 320 have insert top 322 which extend above the upper surface of the base member 310. Therefore, the finished bath mat 300 has an upper surface which is generally planar but has upstanding serpentine ridges formed by the insert tops 322 and serpentine recesses 346. Because the insert members 320 are molded in a completely separate operation from the molding of the base member 310, the insert members can have different characteristics including different colors, different hardnesses, and different surface textures. An improved non-slip top surface which is aesthetically pleasing and provides tactile feedback to user is provided. In essence, the insert portions are pre-molded, secured in the cavity of the mat mold, and the base member molded around and integrally formed with the insert members.

FIG. 26 shows a portion of the bath mat 300 using hollow insert members in greater detail. The base member 310 has suctioned cups 350 integrally molded into its bottom surface. Also, grooves 346 are provided to add additional texture and non-slip characteristics to the top surface of the base member 310. The illustrated insert member 320 is sinuous or serpentine as shown in FIG. 22. In FIG. 26, it can be seen that the insert member 320 is substantially hollow. A recess 360 is defined by insert side walls 362, 364 and the insert top 322. An insert recess rib 368 extends downwardly from the center lower surface of the insert top 322. This construction provides several advantages. The hardness of the insert material can be higher than or very close to the hardness of the base member material while still having a lower perceived hardness to the user. In the preferred embodiment, the base member 310 has a Durometer of 45 (Shore A) and the insert members 320 have a Durometer of 60 (Shore A). The insert members 320 "feel" softer to the user in the finished mat 300 because they are hollow. The use of a higher Durometer material for the hollow insert members 320 allows more precise placement during finish molding. Thus, a blue elastomer of the given hardness (45 Shore A) can be used for the base member 310 and a white elastomer having a different surface texture and higher hardness (60 Shore A) can be used for the insert members (320). The user of the bath mat 300 will perceive the insert members to be softer because of their hollow construction. Texturing and profiling is used to modify perceived physical characteristics.

The embodiments shown in FIG. 22 can be easily modified to include all ribs rather than alternating ribs and grooves. Moreover, the grooves 346 can simply be eliminated and texturing different from the surface texturing of the inserts 320 applied to the entire top surface of the base member 310. The insert members 320 can be solid as illustrated in FIG. 25 or hollow as illustrated in FIG. 26. Preferably, suction cups are added to the under surface of the base member 310.

Figure 2:
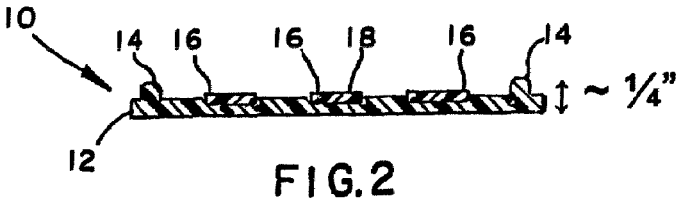
FIG. 2 is a cross section of the bath mat seen in FIG. 1 taken along line 2-2.

As described above, the bath mats illustrated in FIGS. 22-26 are easily manufactured by first molding the insert members 320, placing the insert members 320 into a lower mold half 330 and upper mold half 340, and injection molding the base member 310 which will come into contact with and be joined to the insert members 320 forming an integral bath mat as described above. Of course, variations in the selection of elastomeric materials used, inclusion of transparent or translucent members, inclusion of visual interest members in translucent members, inclusion of third and fourth contrast materials, and different shapes are all consistent with the teachings of the invention set forth above. A gel contained within another material to form a contrast member could be used. Such a structure would add a different feel to the contrast members in a manner similar to the embodiments described above. A finished bath mat in accordance with the present invention will measure approximately 30 inches by 16 inches. The thickest portions of the bath mat will be approximately ¼" thick, as shown in FIG. 2. It will weigh approximately 2 lbs. 14 oz.

While considerable emphasis has been placed on the structures of the preferred embodiments and the processes and relationships in creating these preferred embodiments, it will be appreciated that many modifications and alterations can be made in the embodiments herein illustrated and described without departing from the principals of the invention. For instance, the mat may be used as a kitchen mat or otherwise in the home. Such modifications and alterations will occur to others upon the reading and understanding of this specification. It is intended to include all such modifications and alterations insofar as they come within the scope of the appended claims or the equivalents thereof.

Having thus described the invention, it is claimed:

1. A flexible, unitary, one piece, removable bath mat operable under wet conditions comprising:

a substantially planar elastomeric base member having a depth dimension, substantially uniform characteristics, and a first Shore A hardness, at least one elastomeric contrast member integral with the base member, the contrast member having a second Shore A hardness different from the first hardness;

wherein the Shore A hardnesses of the base member and the at least one contrast member are between about 45 and about 80.

2. The bath mat of claim 1 wherein the base member and the at least one contrast member comprise the same elastomer.

3. The bath mat of claim 1 wherein the base member and the at least one contrast member comprise different elastomers.

4. The bath mat of claim 1 wherein at least a portion of the at least one contrast member penetrates the base member.

5. The bath mat of claim 1 wherein at least a portion of the at least one contrast member penetrates through the base member.

6. The bath mat of claim 1 wherein the base member is disposed around the contrast member.

7. The bath mat of claim 1 having a thickest portion of about one-quarter inch.

8. The bath mat of claim 1 wherein the base member has a bottom surface having a plurality of suction cups integral therewith.

9. The bath mat of claim 1 wherein the base member and the at least one contrast member comprise the same material.

10. The bath mat of claim 1 wherein the base member and the at least one contrast member comprise different materials.

11. The bath mat of claim 1 wherein the base member has a first color and the at least one contrast member has a second color different than the first color.

12. The bath mat of claim 1 wherein the base member has rounded corners.

13. The bath mat of claim 1 wherein the base member is translucent.

14. The bath mat of claim 1 wherein the base member further has a plurality of wavy ribs extending from a top surface of the base member.

15. The bath mat of claim 14 wherein the ribs have the same color and hardness as a bottom surface of the base member.

16. The bath mat of claim 1 wherein the at least one contrast member is solid.

17. The bath mat of claim 1 wherein the base member defines a plurality of apertures extending through the thickness of the base member.

18. The bath mat of claim 1 wherein the base member and the at least one contrast member differ in surface feel.

19. A flexible, unitary, one piece, removable bath mat operable under wet conditions comprising:

a substantially planar base member consisting essentially of a first thermoplastic elastomer, and having a first depth dimension, substantially uniform characteristics, and a first Shore A hardness, at least one contrast member consisting essentially of a second thermoplastic elastomer that is the same as or different from the first thermoplastic elastomer, the contrast member having a second Shore A hardness different from the first hardness, a second depth dimension, and being integral and permanently joined with the base member, wherein at least one of the base member and the at least one contrast member penetrates the other member, the Shore A hardness of the base member and the at least one contrast member is between about 45-80, and the thickest portion of the bath mat is about one-quarter inch.

20. The bath mat of claim 19 wherein the base member and the at least one contrast member comprise the same elastomer.

21. The bath mat of claim 19 wherein the base member and the at least one contrast member comprise different elastomers.

22. The bath mat of claim 19 wherein at least a portion of the at least one contrast member penetrates the base member.

23. The bath mat of claim 19 wherein at least a portion of the at least one contrast member penetrates through the base member.

24. The bath mat of claim 19 wherein the base member is disposed around the contrast member.

25. The bath mat of claim 19 wherein the base member has a bottom surface having a plurality of suction cups integral therewith.

26. The bath mat of claim 19 wherein the base member and the at least one contrast member comprise the same material.

27. The bath mat of claim 19 wherein the base member and the at least one contrast member comprise different materials.

28. The bath mat of claim 19 wherein the base member has a first color and the at least one contrast member has a second color different than the first color.

29. The bath mat of claim 19 wherein the base member has rounded corners.

30. The bath mat of claim 19 wherein the base member is translucent.

31. The bath mat of claim 19 wherein the base member further has a plurality of wavy ribs extending from a top surface of the base member.

32. The bath mat of claim 31 wherein the ribs have the same color and hardness as a bottom surface of the base member.

33. The bath mat of claim 19 wherein the at least one contrast member is solid.

34. The bath mat of claim 19 wherein the base member defines a plurality of apertures extending through the thickness of the base member.

35. The bath mat of claim 19 wherein the base member and the at least one contrast member differ in surface feel.

36. A flexible, unitary, one piece, removable bath mat operable under wet conditions comprising:

a substantially planar elastomeric base member having a depth dimension, substantially uniform characteristics, and a first Shore A hardness, at least one elastomeric contrast member separate from the base member, the at least one contrast member having a second Shore A hardness the same as the first hardness;

wherein the Shore A hardnesses of the base member and the at least one contrast member are between about 45 and about 80.

37. The bath mat of claim 36 wherein the base member and the at least one contrast member comprise the same material.

38. The bath mat of claim 36 wherein the base member and the at least one contrast member comprise different materials.

39. The bath mat of claim 36 wherein at least a portion of the at least one contrast member penetrates the base member.

40. The bath mat of claim 36 wherein at least a portion of the at least one contrast member penetrates through the base member.

41. The bath mat of claim 36 wherein the base member is disposed around the contrast member.

42. The bath mat of claim 36 having a thickest portion of about one-quarter inch.

43. The bath mat of claim 36 wherein the base member has a bottom surface having a plurality of suction cups integral therewith.

44. The bath mat of claim 36 wherein the base member has rounded corners.

45. The bath mat of claim 36 wherein the base member is translucent.

46. The bath mat of claim 36 wherein the base member further has a plurality of wavy ribs extending from a top surface of the base member.

47. The bath mat of claim 46 wherein the ribs have the same color as a bottom surface of the base member.

48. The bath mat of claim 36 wherein the at least one contrast member is solid.

49. The bath mat of claim 36 wherein the base member defines a plurality of apertures extending through the thickness of the base member.

50. The bath mat of claim 36 wherein the base member and the at least one contrast member differ in surface feel.

51. A flexible, unitary, one piece, removable bath mat operable under wet conditions comprising:

a substantially planar elastomeric base member having a depth dimension, substantially uniform characteristics, and a first Shore A hardness, at least one elastomeric contrast member integral and permanently joined with the base member, the contrast member having a second Shore A hardness different from the first hardness;

wherein the base member and the at least one contrast member comprise the same material.

52. The bath mat of claim 51 wherein at least a portion of the at least one contrast member penetrates the base member.

53. The bath mat of claim 51 wherein at least a portion of the at least one contrast member penetrates through the base member.

54. The bath mat of claim 51 wherein the base member is disposed around the contrast member.

55. The bath mat of claim 51 having a thickest portion of about one- quarter inch.

56. The bath mat of claim 51 wherein the base member has a bottom surface having a plurality of suction cups integral therewith.

57. The bath mat of claim 51 wherein the base member has rounded corners.

58. The bath mat of claim 51 wherein the base member is translucent.

59. The bath mat of claim 51 wherein the base member further has a plurality of wavy ribs extending from a top surface of the base member.

60. The bath mat of claim 59 wherein the ribs have the same color and hardness as a bottom surface of the base member.

61. The bath mat of claim 51 wherein the at least one contrast member is solid.

62. The bath mat of claim 51 wherein the base member defines a plurality of apertures extending through the thickness of the base member.

63. The bath mat of claim 51 wherein the base member and the at least one contrast member differ in surface feel.

* * * * *